United States Patent [19]

Benzaquen

[11] 4,012,815

[45] Mar. 22, 1977

[54] APPARATUS FOR ABRADING FABRICS

[75] Inventor: José Benzaquen, Caseros, Buenos Aires, Argentina

[73] Assignee: Benzaquen, Sociedad Anonima, Industrial, Comercial, Immobiliaria y Financiera, Buenos Aires, Argentina

[22] Filed: Feb. 5, 1975

[21] Appl. No.: 547,178

Related U.S. Application Data

[63] Continuation-in-part of Ser. No. 311,261, Dec. 1, 1972, Pat. No. 3,872,557.

[52] U.S. Cl. ..... 26/28; 242/67.2; 242/67.4

[51] Int. Cl.[2] ..... D06C 11/00

[58] Field of Search ..... 26/28, 36, 68; 226/34, 226/183, 199; 242/67.2, 67.4, 75.43, 75.53

[56] References Cited

UNITED STATES PATENTS

| | | | |
|---|---|---|---|
| 1,566,441 | 12/1925 | Smothers | 226/199 X |
| 1,908,029 | 5/1933 | Larson | 51/38 |
| 1,915,106 | 6/1933 | Shuttleworth | 26/28 X |
| 2,027,796 | 1/1936 | Swift, Jr. | 226/34 X |
| 2,462,558 | 2/1949 | Scheuermann et al. | 242/75.43 |
| 2,567,644 | 9/1951 | Leach et al. | 242/67.4 |
| 2,583,674 | 1/1952 | Tobler, Jr. | 242/67.4 X |
| 2,673,692 | 3/1954 | Seyerlein | 242/67.4 |
| 3,229,346 | 1/1966 | Hadley | 26/28 |
| 3,553,801 | 1/1971 | Hadley | 26/28 |
| 3,808,844 | 5/1974 | Oldfield | 26/68 UX |

FOREIGN PATENTS OR APPLICATIONS

| | | | |
|---|---|---|---|
| 17,318 | 1900 | United Kingdom | 26/36 |
| 22,100 | 1914 | United Kingdom | 26/28 |

*Primary Examiner*—Robert R. Mackey
*Attorney, Agent, or Firm*—Allegretti, Newitt, Witcoff & McAndrews

[57] ABSTRACT

Apparatus for conditioning fabrics to alter the tonality and feel of the fabric includes a plurality of spaced guide rollers and rotating abrasion cylinders which are adjustable in elevation relative to the guide rollers. The abrasion cylinders also oscillate transverse to the direction of fabric travel in response to rotation of the cylinders. The tension of the moving fabric is readily controlled and the direction of travel of the fabric is reversible.

20 Claims, 13 Drawing Figures f
48
49
50
51
52
53
54
55
56
57
58
59
60
61
62
63

APPARATUS FOR ABRADING FABRICS

RELATED APPLICATIONS

This application is a continuation-in-part of my copending application, Ser. No. 311,261, filed Dec. 1, 1972, now U.S. Pat. No. 3,872,557.

BACKGROUND AND SUMMARY OF THE INVENTION

The present invention relates to an apparatus for conditioning fabrics and, more particularly, to apparatus for effecting superficial treatment on fabrics in a substantially continuous manner, allowing repetition of the fabric treatment without the need to dismount and reposition the treated fabric roll. In the apparatus of the present invention the direction of travel of the fabric may be reversed so that the fabric runs inversely so as to be repeatedly submitted to the superficial treatment, such reversal being effected as often as it is considered advisable until the desired effect on the fabric is obtained. The reverse operation is automatically effected in response to control means.

In order to obtain such reversible operation, the apparatus is constructed in a substantially symmetrical form with respect to a median transverse plane with regard to its operative means.

Thus, the apparatus of the present invention is especially suited for superficial grinding processes on any type of fabric, particularly in those cases in which it is desired to work with a substantially low longitudinal tension on the fabric in the course of being treated. The apparatus is particularly well adapted for use in performing the process disclosed in my copending U.S. application for Letters Patent Ser. No. 311,261, filed Dec. 1, 1972, and for producing the superficially dyed fabrics disclosed therein.

In the apparatus of the present invention, rotating grinding means are joined to respective rod-crank mechanisms such that the grinding means rotate jointly and are displaced transversely to the fabric path in a compound movement, said alternative transverse displacement being determined by the rotation speed.

Furthermore, the apparatus of the present invention has a novel device to regulate the fabric winding reels, and be virtue of such regulation the longitudinal advance tension of said fabric can be efficiently controlled during treatment. These winding devices are controlled by pneumatic braking and clutching means with adjustable friction.

These and other objects, features and advantages of the present invention will be more clearly understood through a consideration of the following detailed description.

BRIEF DESCRIPTION OF THE DRAWINGS

In the course of this description, reference will frequently be made to the attached drawings in which:

FIG. 3 is similar to FIG. 2, but showing the opposite end of the grinding means and its rod-crank mechanism, partly in section, to show its component parts;

FIG. 13 is a cross sectional elevational view of another embodiment of carrier roll and satellite roller.

DESCRIPTION OF THE PREFERRED EMBODIMENTS

Figure 1:
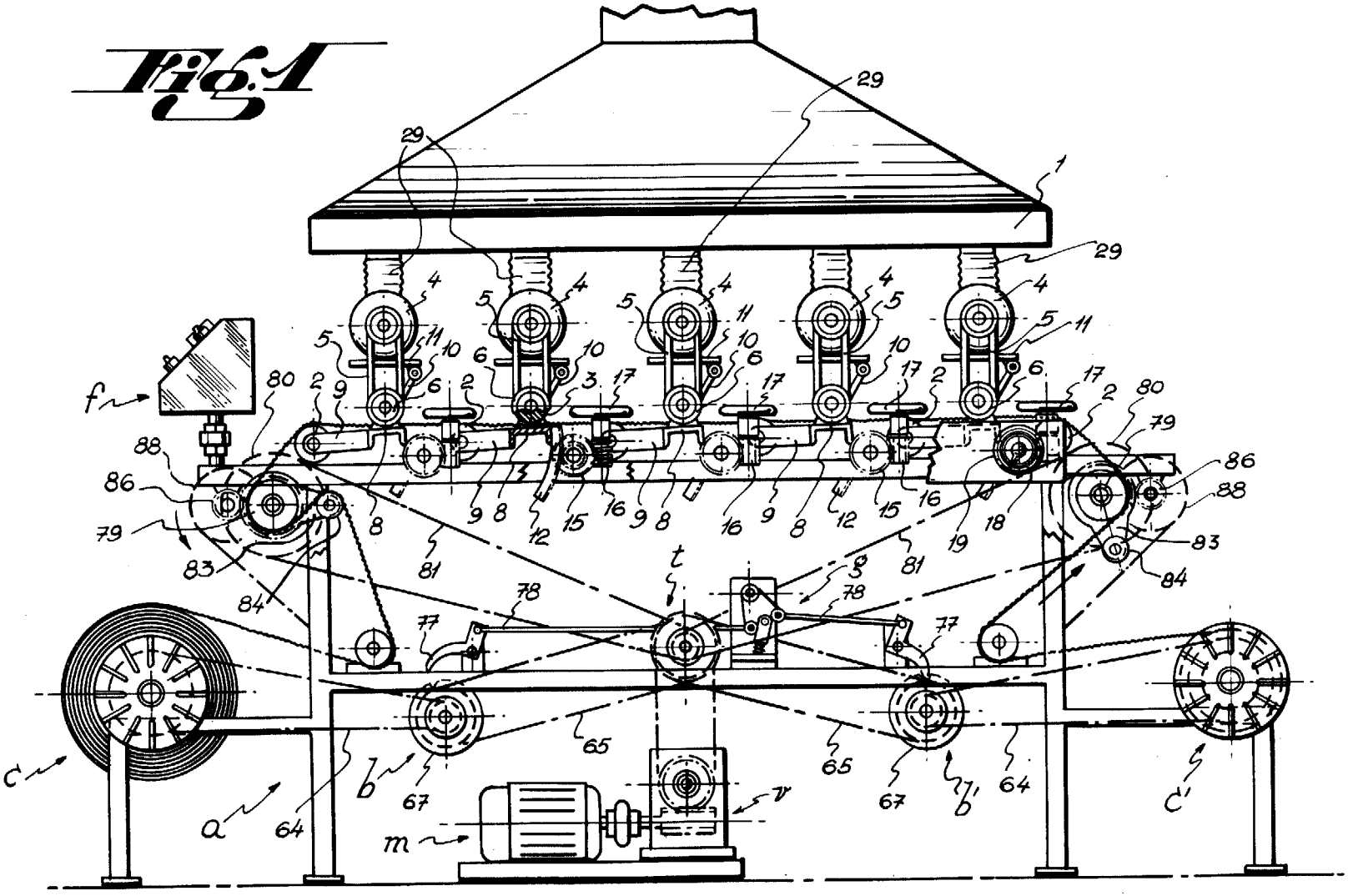
FIG. 1 is a side elevation view showing a schematic of the assembly of the present invention for conditioning fabrics, and in which some of the elements are broken away to show portions thereof.

As shown in FIG. 1, the fabric conditioning apparatus of the invention includes a support structure *a* above which is positioned the hood 1 of a suction system. In the illustrated example of the apparatus that is schematically represented in elevation with respect to the direction of travel of the fabric being treated, the apparatus is substantially symmetrical with respect to a median transverse plane.

Figure 2:
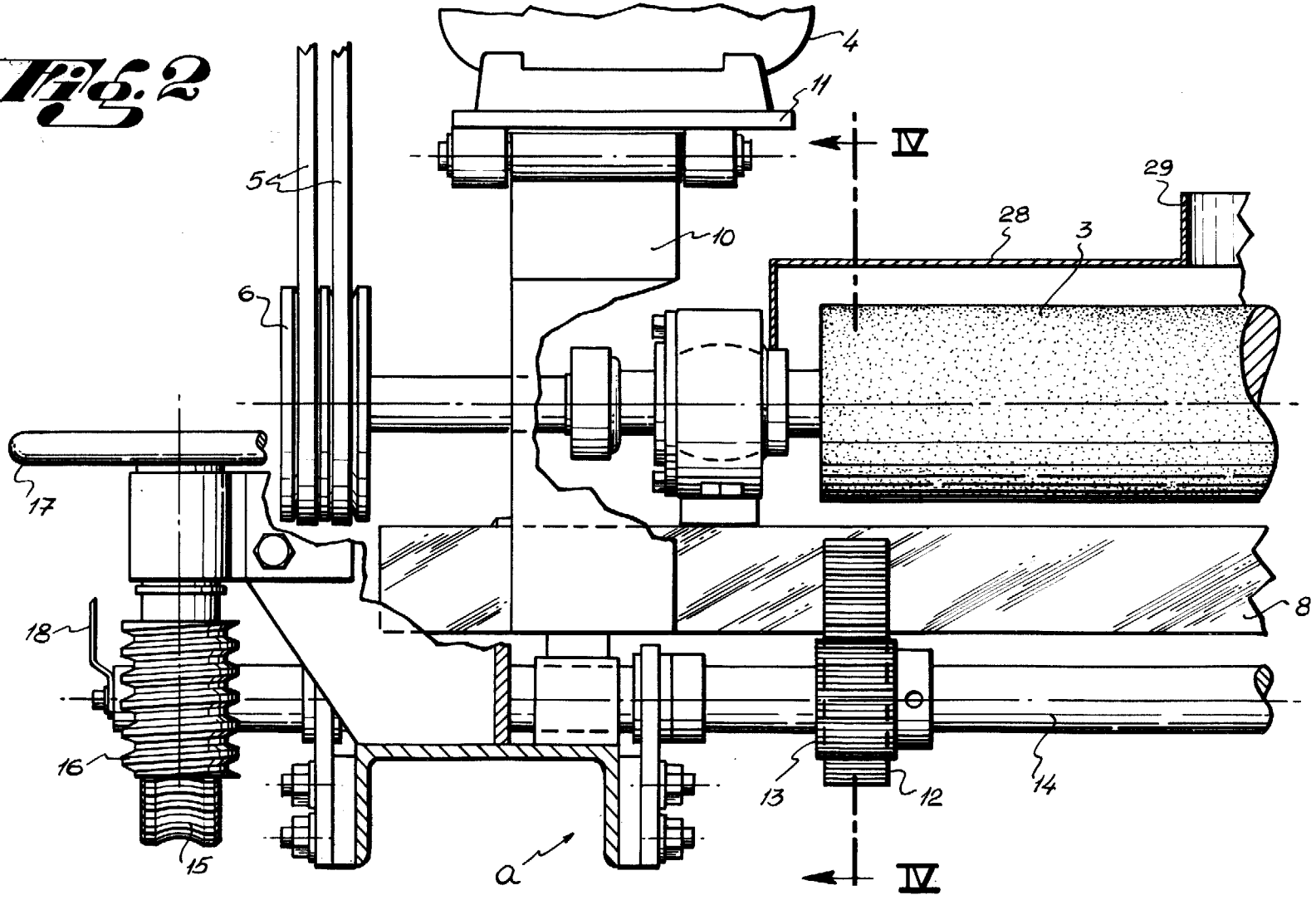
FIG. 2 is a partial end elevational view of the assembly showing an end of one of the grinding means adjacent the operating motor and adjustment mechanism for its relative height.

On the upper portion of structure *a*, the guide rollers 2 are arranged transverse to the path of travel of the fabric and between grinding or abrasion cylinders 3 in the direction of the path of fabric travel. Grinding cylinders 3 constitute the fabric abrasion means. The size of the grain on the surface of cylinders 3 shown in FIG. 2 may be varied to vary the roughness of the cylinders. The grinding cylinders 3 are rotated by respective motors 4 positioned above rollers 3 by means of belts 5 arranged on pulleys 6 fixed on the axles of the cylinders 3 as shown in FIGS. 1 and 2. The direction and speed of the motors 4 may be individually controlled to control the speed and direction of the individual grinding cylinders 3 as desired. The grinding cylinders 3 may be made to rotate either opposite to or in the same direction as the direction of travel of the fabric through the assembly or individual ones of the cylinders may rotate in opposite directions.

Figure 4:
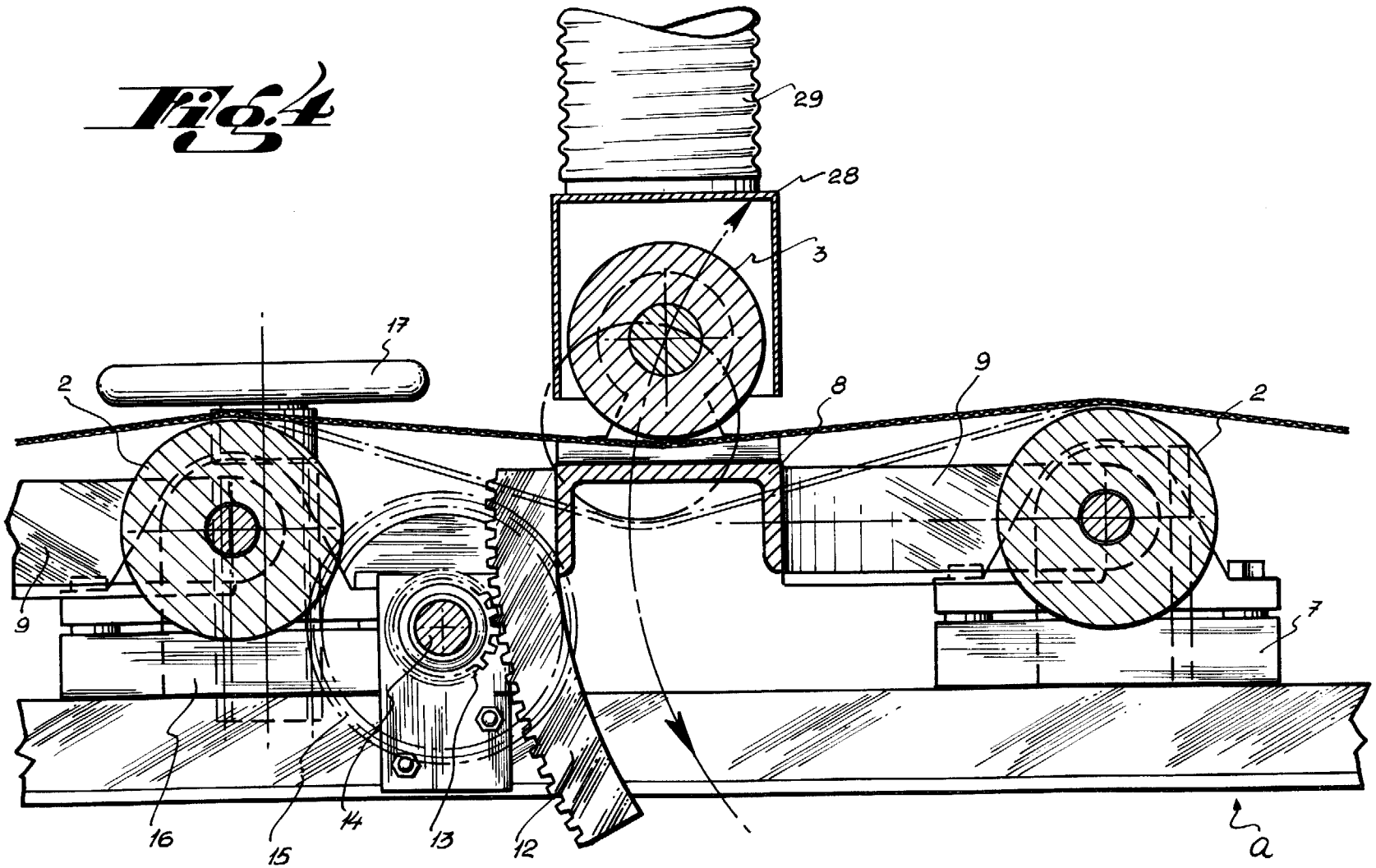
FIG. 4 is a cross sectional, partial side elevational view on line IV—IV of FIG. 2 showing the height adjustment mechanism of the grinding means.
Figure 5:
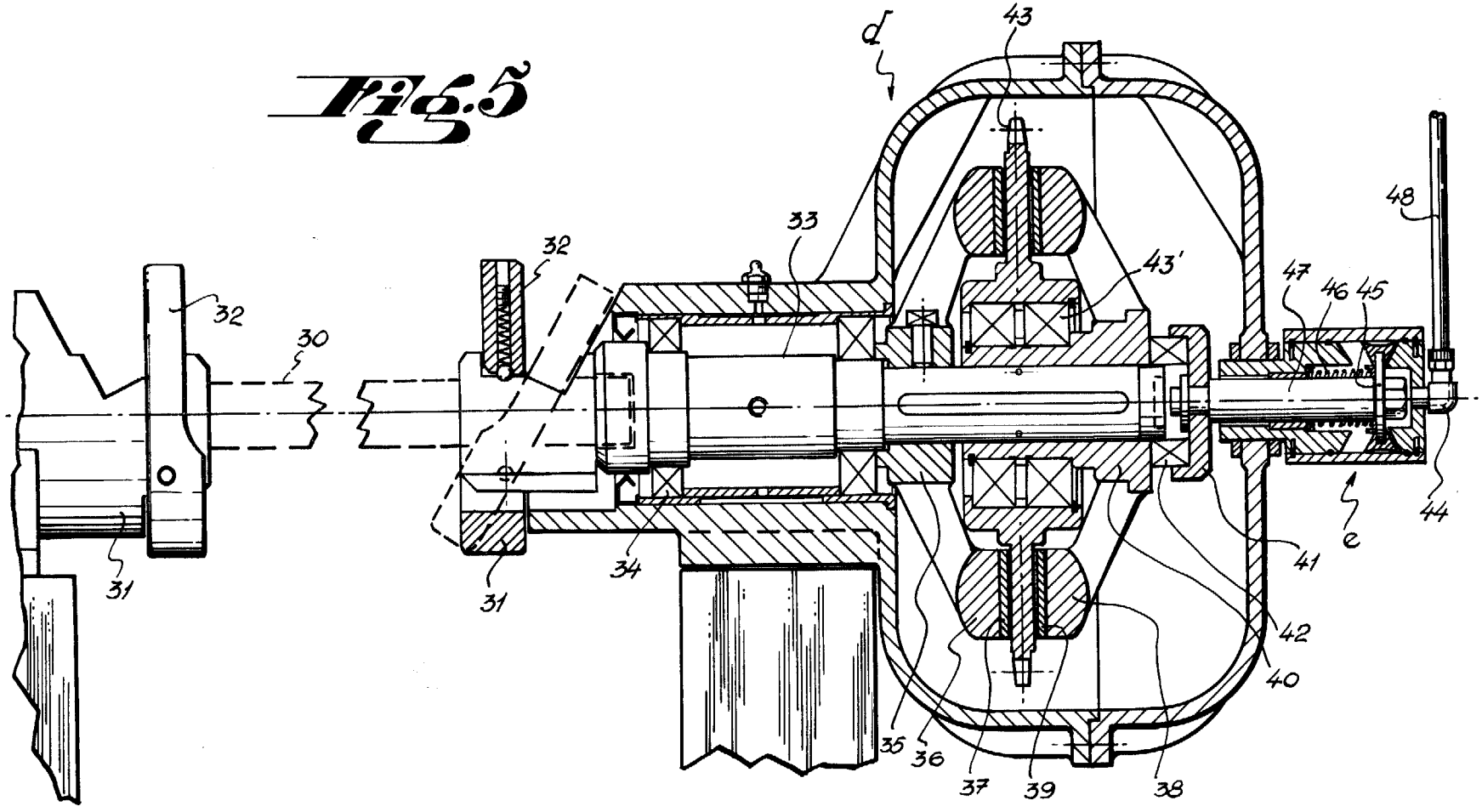

As shown in detail in FIG. 4, the guide rollers 2 are mounted on supports 7 which are fixed to the structure *a* while each of the grinding cylinders 3 is mounted on a shaped support 8 which extends transversely of the apparatus and which is fixed on one end of arms 9. Arms 9 are hinged on both sides of the guide rollers 2 at the supports 7 of same. The arms 9, with the support 8 of a respective grinding cylinder 3, are angularly displaceable in an arc, the center of which substantially coincides with the axle of the corresponding guide roller 1, as shown in FIG. 4. Referring to FIGS. 1 and 2, rigid support members 10 support platforms 11 on which the motors 4 are mounted and are fixed to supports 8. Thus the spacing between the grinding cylinders 3 and platforms 10 is fixed during operation and both are simultaneously adjustable in elevation.

On both sides of the supports 8 opposite arms 9, sectors 12 are fixed. Sectors 12 are toothed and these teeth mesh with pinions 13 of complementary axles 14. One side of each axle 14 projects from structure *a* and carries a sprocket 15 which meshes with an endless thread 16 which is controlled by a handwheel 17. Each grinding cylinder includes the latter subassembly to vary the height of cylinders 3 individually with reference to the guide rollers 2 and with such height variations, the pressure on the fabric being treated and the contact angle of same on cylinders 3 may also be varied. The ends of the complementary axles 14 have respective gauges mounted thereon that register the angular displacement of the corresponding quadrants 18 and may be scaled at 19 to read in contact angle or pressure or both.

The ends of the axles of the grinding cylinders 3 opposite the pulley assemblies 6 each include a shaft extension 20 with an endless thread 21. Thread 21 meshes with a gear 22 as shown in FIG. 3. Each gear 22 is eccentrically pinned at 23 to the end of rod arm 24, the opposite end of which is at the same time pinned to a point 25 on support 8.

The thread 21 and the gear 22 are housed within a housing 26 mounted on bearings 27, through which the shaft 20 is journaled, such that the axle shaft 20 rotates with respect to the housing, but is connected with the housing for common axial displacement therewith in the manner pointed out by the arrows in FIG. 3 which show the axial oscillation of the axle.

As shown in FIG. 3, the gear 22 is continuously intermeshed with thread 21 to continuously rotate the gear while shaft 20 rotates. Since arm 24 is pinned to the support 8 at 25 and is eccentrically pinned to the gear 22 at 23, the shaft 20, endless thread 21, gear 22 and housing 26 will be displaced in oscillatory motion during rotation of cylinder 3 as shown by the arrows, thereby imparting the grinding cylinder 3 with a transverse movement relative to the direction of travel of the fabric simultaneously with rotation of the cylinders. Moreover, the speed of such transverse oscillations will be a function of the speed rotation of the grinding cylinders 3. The transverse oscillations of the grinding cylinders 3 are important in the prevention of streaking in the fabric.

The grinding cylinders 3 are preferably covered on the sides and top, by covers 28 from which channels 29 extend to the suction system 1.

Figure 5:
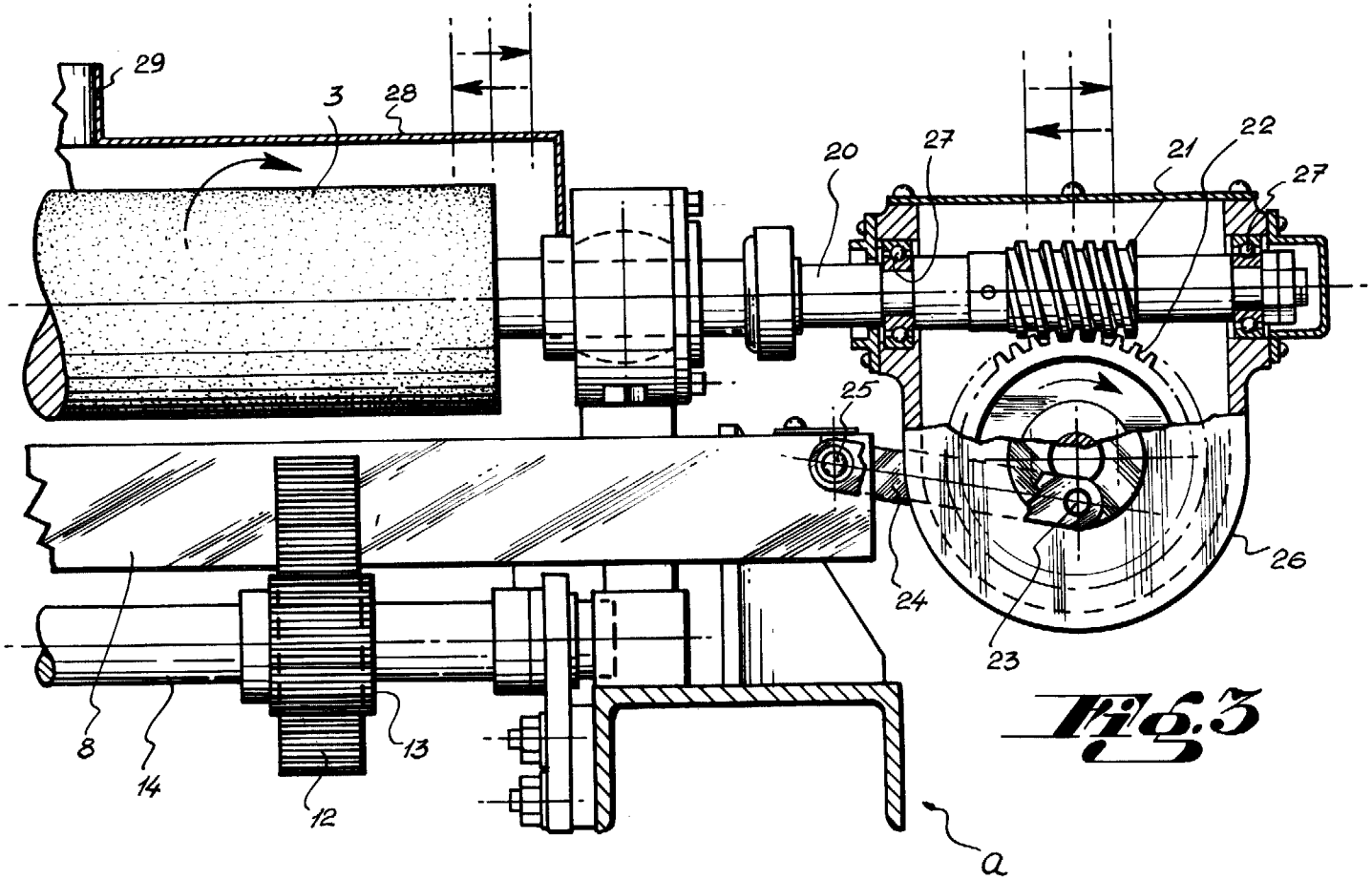
FIG. 5 is a cross sectional end view showing a longitudinal section of the axle on which the fabric is wound and of the pneumatic operating mechanism therefor.

The rollers or reels on which the fabric is wound, rollers *c* and *c'* shown in FIG. 1, are mounted at both ends of the machine. Both rollers *c* and *c'* have control devices. As shown in FIG. 5, a shaft 30, of square or similar section, is removably positioned on one side in a support 31 which preferably is open at the top and a fastening element 32 may be angularly displaced for locking or unlocking the shaft 30 with an axle 33. Axle 33 is journaled through bearings 34 and extends in housing *d*.

The core 35 of an annular piece 36 is fixed on axle 33 in housing *d*. The annular piece 36 also includes a friction surface 37 facing a similar annular piece 38 which also has a friction surface 39. The second annular piece 38 has a core 40 comprising a sleeve or bushing which is keyed to axle 33 and is axially displaceable on axle 33 by means of a thrust member 41 with bearings 42. Thus, the friction surface 37 of the annular piece 36 is fixed on axle 33 and the friction surface 39 and its annular piece 36 are axially displaceable and both rotate with the axle. A plate or sprocket 43 rotates freely on axle 33 on bearings 43' and is arranged between friction surfaces 37 and 39. Sprocket 43 is adapted to be driven by a chain 64 which passes through an opening (not shown) of casing *d*, but sprocket 43 may be locked against rotation as will be described in detail hereafter.

Figures 6, 7, 8:
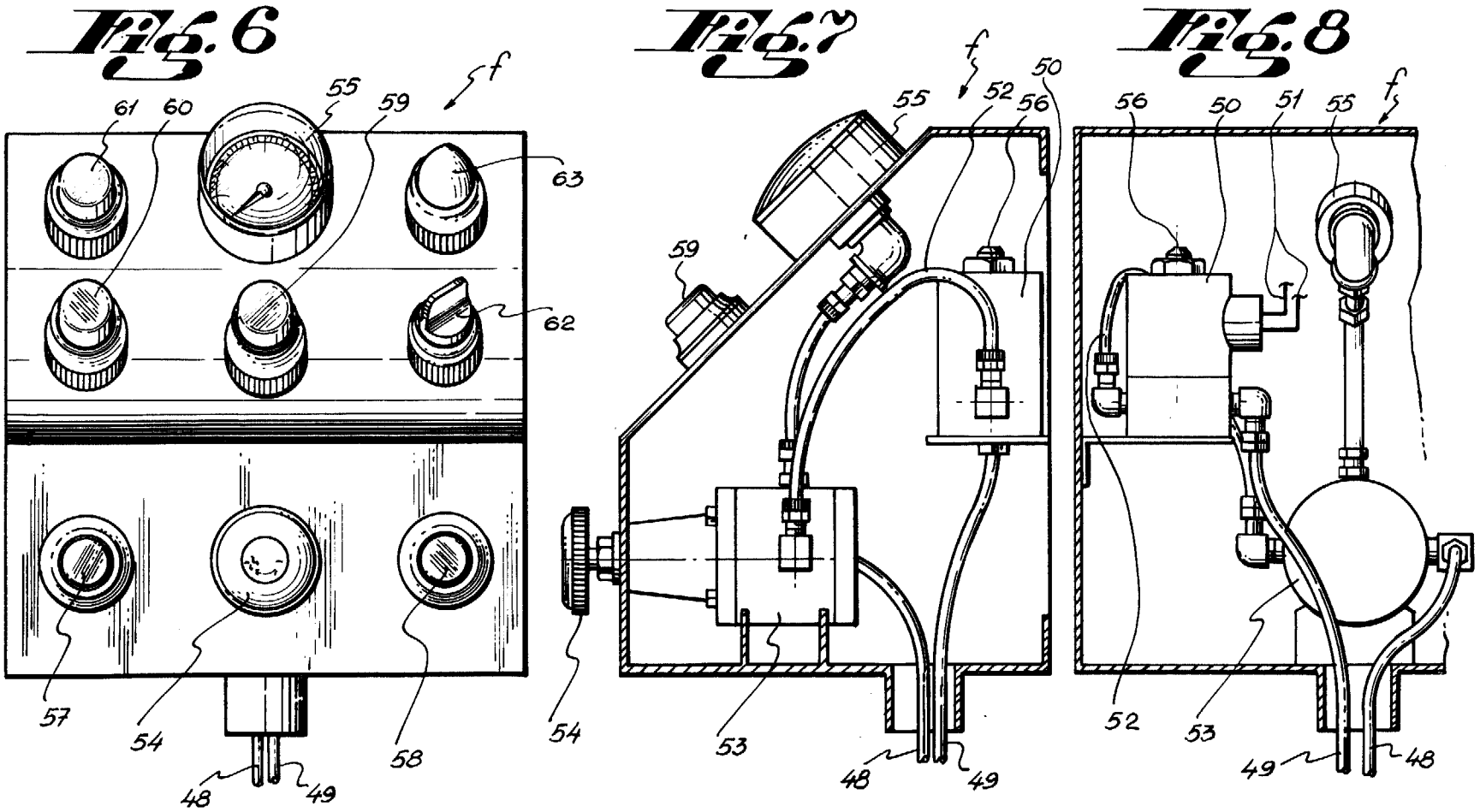
FIG. 6 is a front view of the control cabinet of the assembly.
FIG. 7 is a cross sectional side elevational view of the control cabinet shown in FIG. 6.
FIG. 8 is a cross sectional partial view of the control cabinet shown in FIG. 6.

A box or cylinder *e* is fixed to casing *d* as shown in FIG. 5. Cylinder *e* has a connection 44 for communicating air under pressure to a pneumatic microcylinder whose piston 45, against which the return spring 46 operates, is joined to the thrust member 41 by means of a rod member 47. The air pressure conduit 48 to each of the control devices of the rollers *c* and *c'*, is supplied from a control housing *f*, which can be located in any suitable location such as at one of the ends of the apparatus as shown in FIG. 1. The control housing *f* is illustrated in FIGS. 6, 7 and 8.

A conduit 49 from a source of air pressure extends into the control housing *f* to a two way valve for microvalve 50. The valve 50 is preferably controlled electrically through conductors 51 shown in FIG. 8.

An air conduit 52 is connected to a control valve 53 which valve may be controlled externally of the housing by knob 54 to vary the air pressure in pipe 48 and thereby, control the friction clutching and braking action in assembly *d* at each end of the machine. From control valve 53, the air is conducted by pipe 48 which is connected to box *e* of the microcylinder to operate the thrust member 41. Air from pipe 48 may also be diverted to manometer 55 on housing *f* for personnel monitoring. The two way valve 50 also includes an exhaust or discharge outlet 56.

One control valve 53 is preferably provided for the assembly *d* at each end of the machine. One valve 53 ports air to the takeup end of the machine, roller *c* as shown in FIG. 1, to cause the friction surfaces 37 and 39 to perform a clutching function against rotating plate 43 to drive axle 33 of the takeup roller *c*. The other valve also ports air to the feed or unwind end of the machine, roller *c'* as shown in FIG. 1, to cause the friction surfaces 37 and 39 to perform a braking function against locked plate 43 to brake axle 33 of the feed or unwind roller *c'* and, thereby, prevent roller *c'* from freewheeling. Both of these valves 53 may be controlled by a single knob 54 such that as one of the valves is being opened while the other is being closed to compensate for the inversely porportional changes in diameter of the fabric at the rollers *c* and *c'* during operation of the machine. If desired, separate control knobs 54 may be provided for each valve.

In addition to the knob 54 for operating the control valve 53, the control housing *f* also includes a starter button 57 and stop button 58 on its front for starting and stopping the suction device 1. The housing *f* also includes a button 59 for stopping the apparatus, buttons 60 and 61 for starting and reversing, respectively, the apparatus, a button 62 for starting the electrovalve 50, and a pilot light 63 for indicating operation of the apparatus. The electrical control circuitry is not illustrated, since any number of suitable circuits are available and well within the selection of one skilled in the art.

As shown in FIG. 1, the sprockets 43 of the control devices of the rollers $c$ and $c'$ on which the fabric is wound are connected by chains 64 to the respective mechanisms $b$ and $b'$, the latter of which are also connected by chains 65 to a multiple transmission mechanism $t$ that is driven from the speed variator $v$ of motor $m$ as shown in FIG. 1.

Figure 10:
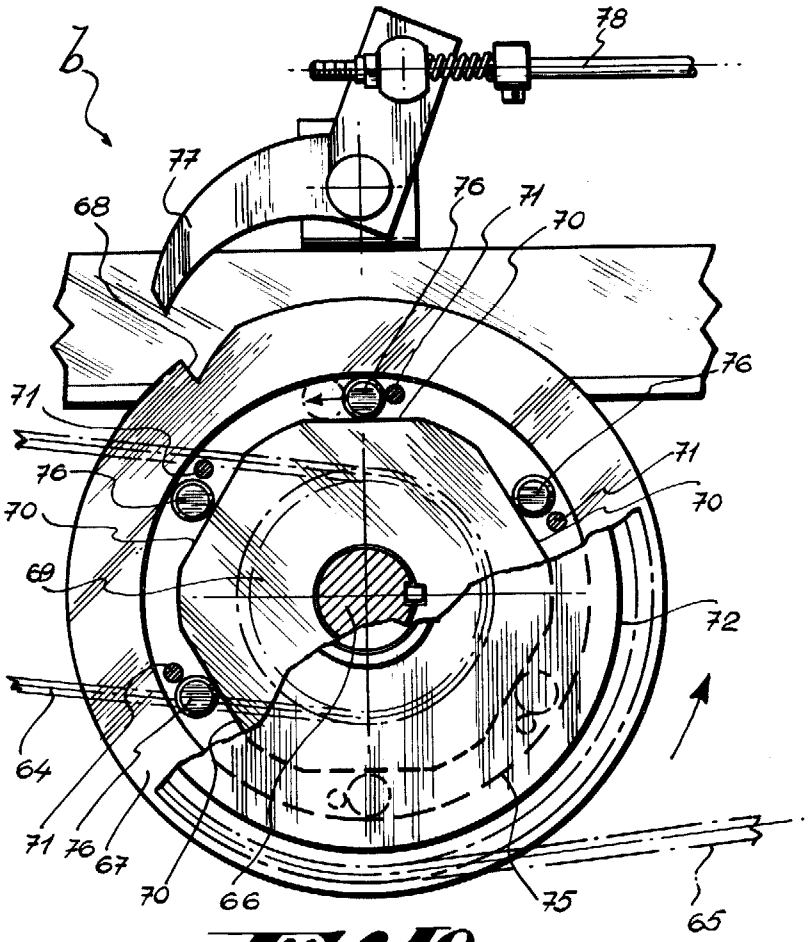
FIG. 10 is a partial elevational view of the jack-wheel shown in FIG. 9.
Figure 9:
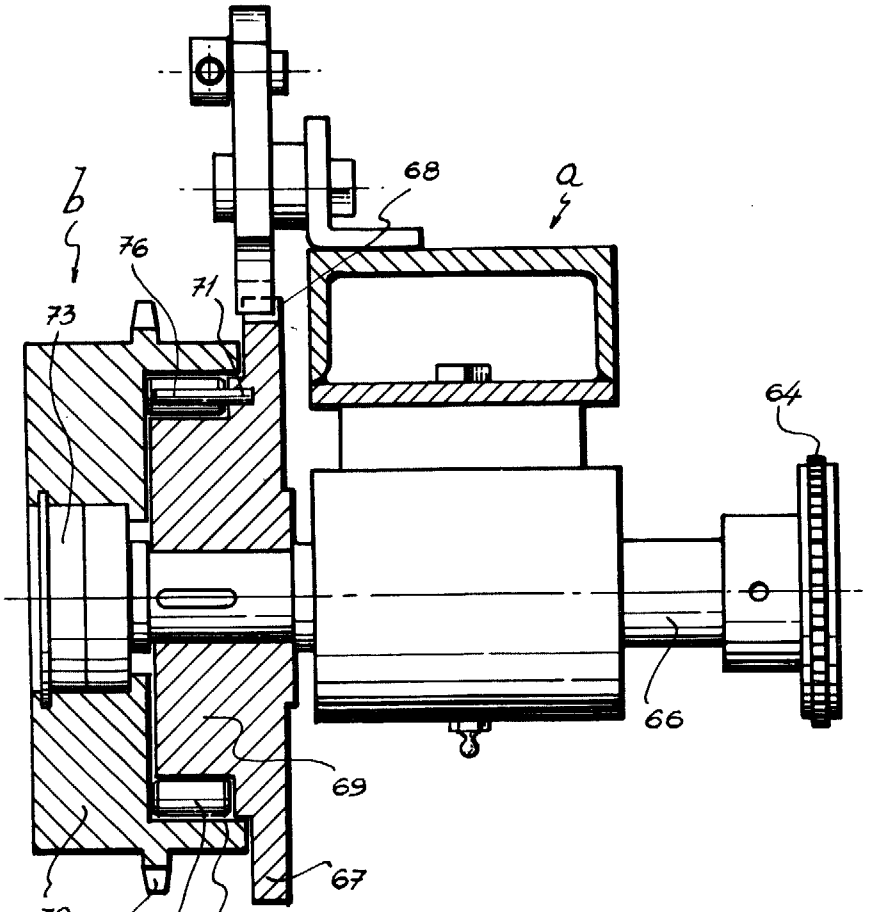
FIG. 9 is a cross sectional end view showing the jack-wheel for reversing the direction of fabric travel in the assembly.

Mechanisms $b$ and $b'$ allow reversal of the rollers $c$ and $c'$ on which the fabric is wound. As shown in FIGS. 9 and 10, each of the mechanisms $b$ and $b'$ include a ratchet mechanism including an axle 66 connected with the sprocket of chain 64 and on which a disk-shaped piece 67 is fixed. A single notch 68 is formed on the perimetral edge of piece 67. A portion 69 also projects from the disk-shaped portion having straight sides 70 to form, for example, a hexagon. Bolts 71 extend from the disk-shaped portion 67 in spaced relation to the sides 70 as shown in FIGS. 9 and 10.

A piece 72 is mounted on the end of axle 66 and rotates on bearings 73. Piece 72 has sprocket teeth 74 which are engaged by continuously drive chain 65, the latter of which is connected to the transmission mechanism $t$. Piece 72 has a cylindrical recess 75 surrounding the hexagonal shaped central portion 69. Freely displaceable rollers 76 are positioned at each side 70 of portion 69 between the sides 70 and the recess 75 of piece 72. These rollers 76 constitute wedging means between said pieces 67 and 72. When piece 72 is rotated in the direction of the arrow in FIG. 10 by transmission $t$ and chain 65, the internal cylindrical perimeter of piece 72 pulls the rollers 76 to the dot and dash position shown in FIG. 10 to wedge them between the straight line surface 70 of portion 69 of piece 67 and the cylindrical perimeter of piece 72 to drivingly rotate piece 67 thereby imparting movement through chain 64 to the corresponding roller $c$ on which the fabric is wound.

When the piece 72 is rotated in the opposite direction to the arrow in FIG. 10, the rollers 76 are pulled to the non-wedging position shown in solid in FIG. 10 and are there held by the fixed bolts 71 to prevent wedging at the other side of flat surface 70. Consequently, the piece 72 rotates freely, but does not drive portion 67 or roller $c$. In this condition roller $c$ acts as a supply or unwind roller. When piece 67 is disengaged in this manner, it is immobilized by the lock pawl 77 which engages notch 68. Since piece 67 is locked, chain 64 will also be locked, locking plate 43 in assembly $d$ shown in FIG. 5.

The lock pawl 77, one for each mechanism $b$ and $b'$, is connected by means of rods 78 to a control mechanism $g$ as shown in FIG. 1, such that, when one pawl is engaged in one notch, the other is raised.

When a roller $c$ is rotated to wind up the fabric, the corresponding roller $c'$ at the opposite end of the machine is dragged by the fabric that unrolls from it. Since the sprocket 43 of the unwind roller $c'$ is locked against rotation by chain 64, piece 67 and engaged pawl 77, roller $c'$ may be selectively braked pneumatically by friction surfaces 37 and 39 to as to prevent it from freewheeling as the diameter of the fabric on the unwind roller $c'$ changes.

Thus, the fabric to be treated may be reversibly passed from one to the other roller $c$ and $c'$ without dismounting the rollers by simply reversing the aforesaid mechanism.

Figure 11:
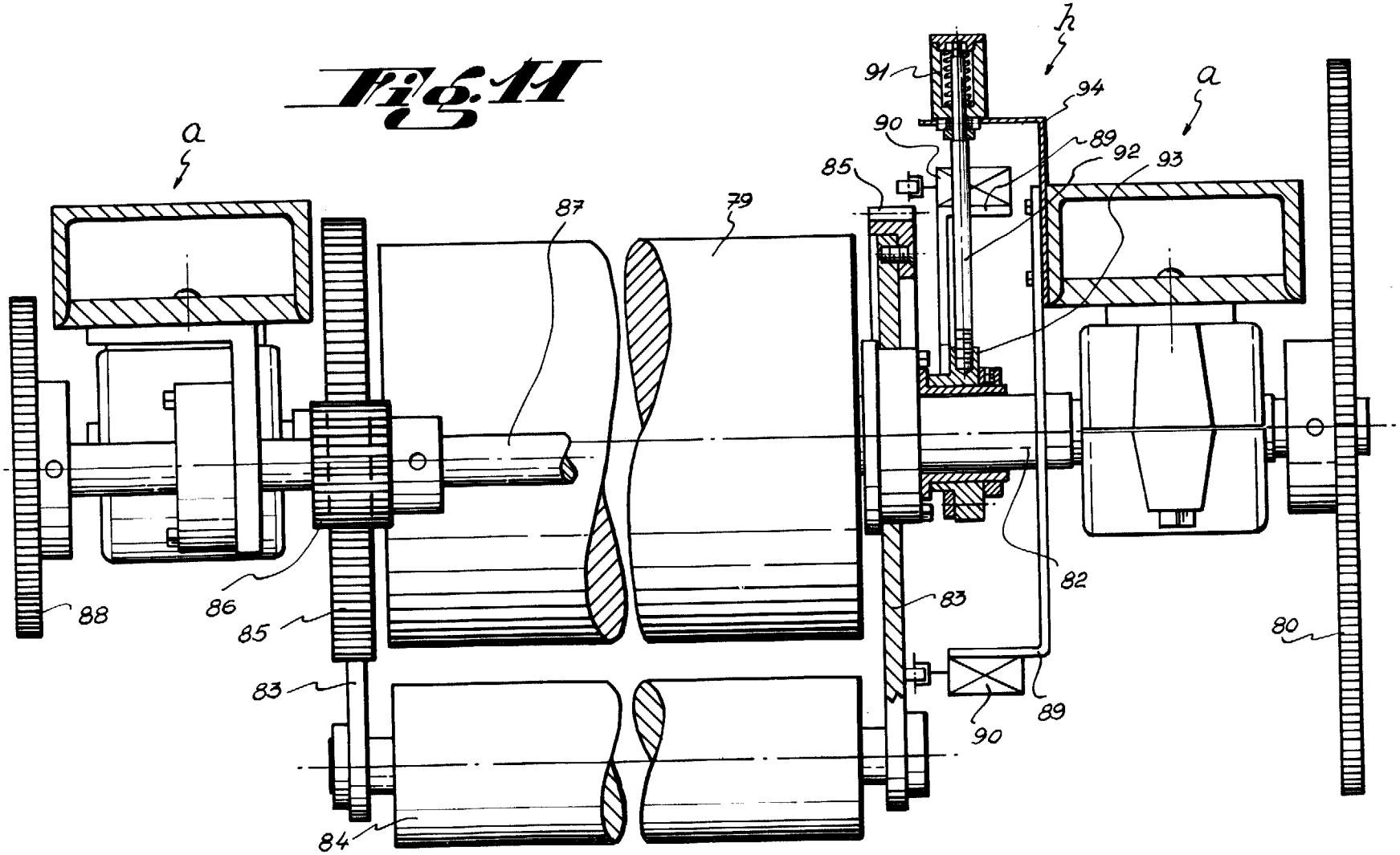
FIG. 11 is a cross sectional end view of the satellite roller of the fabric carrier roll with its toothed displacement transmission and the position fixing means.
Figure 12:
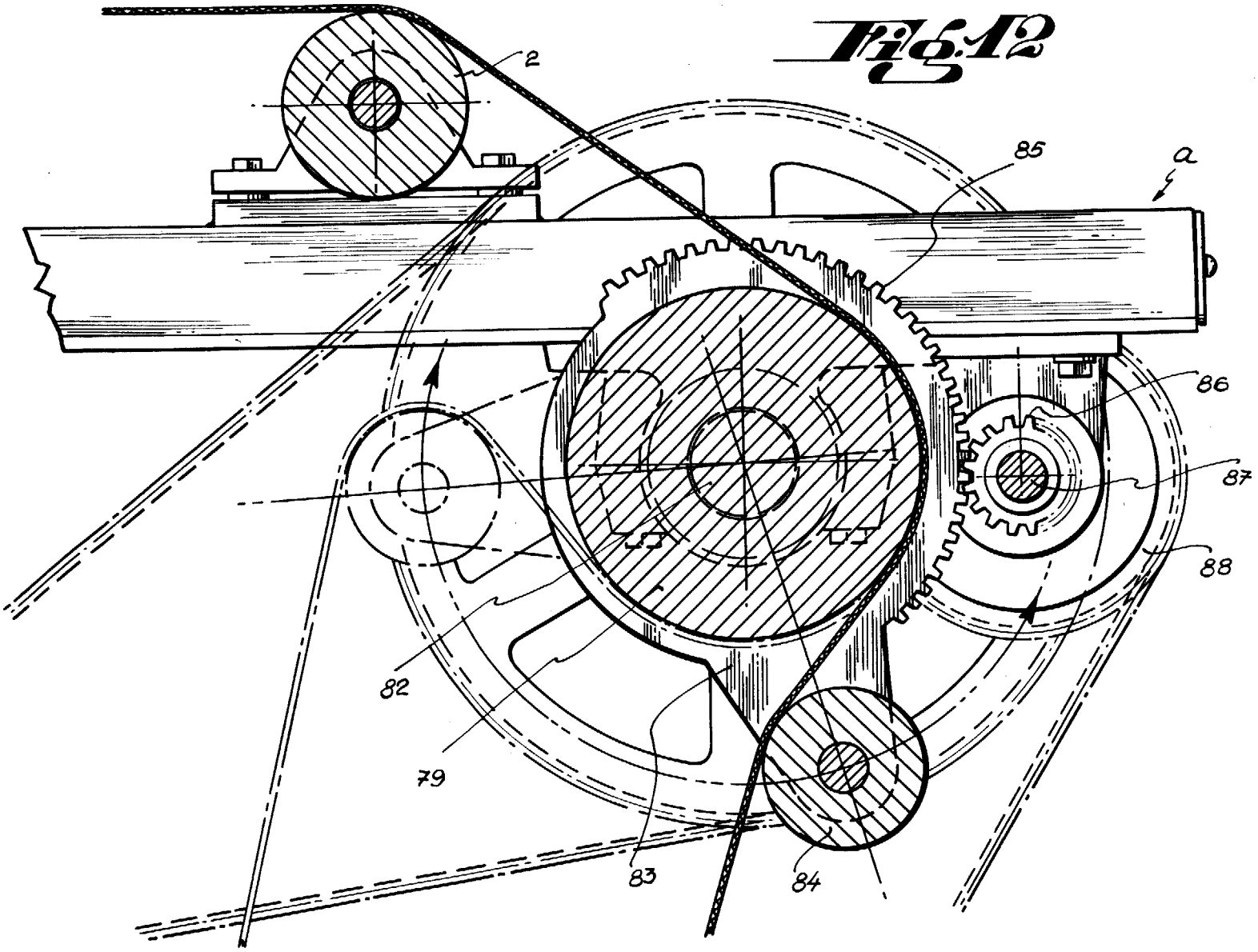
FIG. 12 is a cross sectional elevational view showing the carrier roll with its satellite roller as shown in FIG. 11, and showing two positions of the satellite roller in solid and dot and dash.
Figure 15:
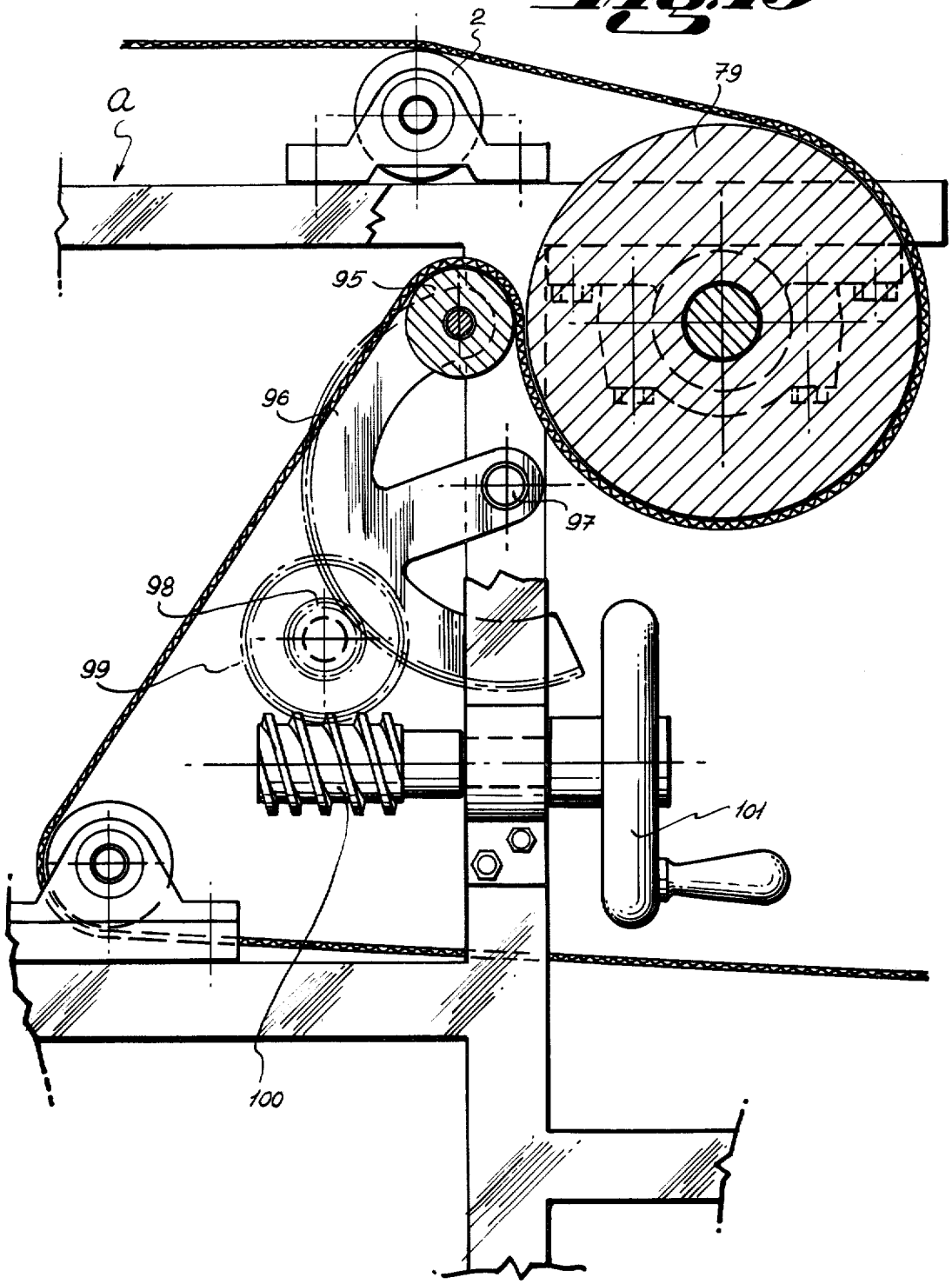

Between the terminal guide rollers 2 and their corresponding rollers $c$ and $c'$ at each end of the apparatus, carrier rolls 79 are positioned as shown in FIG. 1. Sprockets 80 are carried by rolls 79 which are connected by chains 81 to the transmission mechanism $t$ as shown in FIGS. 1, 11, and 12. The carrier rolls 79 have a rubber or the like surface and the sprockets 80 drive the rolls through axles 82. Arms 83 are mounted on the carrier rolls 79 which support satellite rolls 84 which extend parallel to rolls 79. Arm 83 has a toothed sector 85 on one side which meshes with a pinion 86 on a control shaft 87 that is driven by sprocket 88.

The fabric under treatment passes around the corresponding carrier roll 79, as shown in FIGS. 1 and 12, at each end of the machine. At the end of the apparatus at which the winding reel is located, e.g. reel $c$ in FIG. 1, the satellite roll 84 is displaced upwardly to a position in which the fabric is wrapped over a greater amount of the surface of carrier roll 79, while at the opposite end of the apparatus, the satellite roll 84 is displaced in an arc downwardly to a position in which the fabric is wrapped over a smaller arc of the roller 79. The upwardly displaced position is shown in dot and dash in FIG. 12 and the downwardly displaced position is shown in solid. As already mentioned, displacement of each of the satellite rolls 84 is controlled by means of shaft 87 which is driven by sprocket 88 and whose pinion 86 meshes with the toothed sector 85 of arm 83.

Thus, when the satellite roll 84 is moved to its upper position at the takeup or winding end of the assembly, the area of contact with roller 79 is increased. The fabric is therefore grasped with greater friction at this roll, and is removed from the unwind roller $c'$ and effectively drawn into the assembly over the roller 79 at the unwind end of the assembly. Since both rollers 79 rotate at the same speed, the fabric passing over guide rollers 2 is substantially untensioned.

Referring to FIG. 11, a satellite roll adjustment mechanism $h$ is shown which surrounds the carrier roll 79. Mechanism $h$ determines the final positions of the satellite roll displacement. Mechanism $h$ includes end of run supports 89 and microswitches 90 that face a support arm 83. An operating handle 91 is connected with a rod 92 threaded into a bushing 93. The handle 91 is movable through a slot on the cover 94 the latter of which is fixed to the basic structure $a$. Thereby, the position of the microswitches 90 may be adjusted to determine the upper and lower limits of movement of the satellite roll 84. The sprocket 88 for transmitting movement to the control axle 87 of the satellite roll 84 is driven by way of an independent motor, rotation direction and starting and stopping of which is controlled by microswitches 90.

It is believed that the operation of the present invention will be clear from the foregoing description of the assembly. However, for purposes of clarity, a brief description of the operation of the assembly is as follows.

Prior to starting the assembly, the height of the grinding cylinders 3 is initially adjusted by way of hand wheels 17 such that the angle at which the fabric contacts the respective grinding cylinders is preset, as shown in FIG. 4, for the particular fabric and finishing result desired. A roll of the fabric to be processed is then mounted at roller $c'$ as viewed in FIG. 1, and the control mechanism $g$ is set so that locking pawl 77 engages notch 68 on piece 69 of jack mechanism $b'$ and pawl 77 is disengaged from notch 68 on mechanism $b$, as shown in FIG. 1. Since roller $c'$ will supply the fabric and will be an unwind roller at least initially, and roller $c$ will act as a takup roller, the satellite mechanism of guide roller 79 at the left side of the machine will be operated to move the satellite roller 84 to the upper position to maximize the area of contact between the fabric and guide roller 79 and the satellite roller 84 at the right end of the machine adjacent supply roller $c'$, will be moved to its lower position as shown in FIG. 1.

The assembly is now ready for threading. At this point push button 57, shown in FIG. 6, may be pushed to start the suction hood assembly 1 and push button 60 to start the machine. When the machine is started, motors 4 will drive the respective grinding cylinders 3 by way of belts 5 at a predetermined speed and in a predetermined direction as is desired for the conditioning of the particular fabric. Grinding cylinders 3 preferably rotate in a direction opposite to the direction of the travel of the fabric through the machine, but may, if desired, rotate in the same direction. Moreover, if desired, individual ones of the grinding cylinders may be made to rotate in opposite directions or at different speeds from other ones of the cylinders. In addition, the carrier rolls 79 will be driven at the same speed.

A conventional leader may now be attached to the leading end of the fabric on roller $C'$ which is to be threaded. through the machine. This leader is threaded from roller $c'$, between the lowered satellite roller 84 and carrier roll 79 at the right end of the machine as viewed in FIG. 1, beneath the grinding cylinders 3 and over the guide rollers 2, around roll 79 at the left end of the machine and the raised satellite roller 84, and onto the takeup roller $c$.

As shown in FIGS. 1, 9 and 10, the takeup roller $c$ is driven by way of transmission $t$, chain 65, teeth 74, piece 72, portion 69 which is driven by the wedged rollers 76, axle 66, and chain 64, which drives plate 43 in assembly $d$, as shown in FIG. 5, which drives axle 33 and takeup roller 30. The speed of the takeup roller $c$ is controlled by selectively porting air, as controlled by knob 54 shown in FIGS. 6 and 7, through conduit 48 to move thrust member 41 to cause friction surfaces 37 and 39 to engage plate 43 with a variable friction. Since plate 43 is being rotated by chain 64, a predetermined amount of this rotation will be imparted to annular members 36 and 38, depending upon the degree of slip between the plate 43 and friction surfaces 37 and 39. When winding is commenced on takeup roller $c$, roller $c$ will be driven at a higher speed by porting more air through conduit 48 causing the friction surfaces 37 and 39 to firmly engage plate 43. As the diameter of the fabric on roller $c$ increases, the rotational speed of the roller $c$ is decreased by reducing the air pressure on thrust member 41 to cause slip between plate 43 and friction surfaces 37 and 39. In any event, the speed of the takeup roll $c$ is controlled, such that it is just sufficient to collect the fabric which has been processed and maintain the fabric between roller $c$ and the carrier roller 79 at the takeup end of the machine in a non-slackened condition. The actual movement of the fabric through the machine is caused by the pull exerted by the carrier roll 79 and raised satellite roll 84 at the takeup end of the machine. Since the speed of the carrier rolls 79 at the opposite ends of the machine is identical, the longitudinal tension on the fabric being processed between those rolls is negligible.

Conversely, the supply or unwind roller $c'$ at the other end of the machine is disconnected from transmission $t$. Although chain 65 of the mechanism $b'$ is being driven, pawl 77 is engaged in notch 68 causing rollers 76 to move to the solid position, shown in FIG. 10, thereby disengaging axle 66 from the continuously rotating portion 72. Thus, roller $c'$ will not be driven by chain 64, but will be moved simply by the fabric as it is being withdrawn from the roller.

The speed of rotation of the unwind roller $c'$ is accurately controlled also by selectively porting air, as controlled by knob 54 shown in FIGS. 6 and 7, through its conduit 48 so as to move the thrust member 41 causing friction surfaces 37 and 39 to engage plate 43. The speed of rotation of roller $c'$ is variably controlled to prevent freewheeling by the amount of air pressure introduced to the thrust member 41. Since plate 43 is locked by the action of pawl 77 in mechanism $b'$, introduction of air to thrust mechanism $e$ will cause the friction surfaces 37 and 39 to slip against locked plate 43 to brake unwind roller $c'$. The tension between carrier roll 79 at the unwind end of the machine and roller $c'$ will be minimal, since the area of contact of the fabric with driven roll 79 is minimized due to lowering the satellite roller 84 at the take off end of the machine. The rotating speed of roller $c'$ will increase as fabric is removed from the roller and of roller $c$ will decrease as fabric is collected and these speeds may be readily controlled by adjusting the braking or clutching forces exerted upon plates 43 by controlling the air pressure introduced through conduits 48 to the thrust members $e$ of the rollers $c$ and $c'$.

As the fabric moves through the machine at a constant predetermined speed as determined by the speed of carrier rolls 79, its upper surface will be ground by the rotative motion of grinding cylinders 3. In addition, as the grinding cylinders 3 rotate, such rotative force will be imparted, as shown in FIG. 3, through axle 20, pinion 21 and gear 22 to cause gear 22 to rotate. Since arm 24 is fixed at 25 at its other end, rotation of gear 22 will cause the gear and housing 26 to move back and forth as shown by the arrows in FIG. 3. Thus, the grinding cylinders 3 will not only rotate, but will be transversely oscillated at an oscillation rate which is a function of the rotation speed of the cylinders to prevent streaking of the fabric and substantially improve the quality of the final product.

Once the entire roll of fabric has been unwound from roller $c'$, has passed through the assembly and has been collected on roller $c$, roller $c$ may be removed if conditioning has been completed. However, if it is desired to pass the fabric back through the machine for repeated grinding, the machine may be simply reversed by pressing button 61 shown in FIG. 6.

Upon reversal, mechanism $g$ is reversed such that pawl 77 engages notch 68 of mechanism $b$ and disengages notch 68 of mechanism $b'$. Thus, roller $c'$ will now become the takeup roller and will be driven by mechanism $b'$ by way of chains 65 and 64. Conversely, mechanism $b$ will be disengaged, since its rollers 76 will now move to the solid position shown in FIG. 10. The thrust mechanism 41 of assembly $d$ at roller $c$ will now be engaged as previously described with respect to the same assembly $d$ of roller $c'$ and the satellite roller 84 at the left end of the machine, as viewed in FIG. 1 will be lowered and satellite roller 84 at the right end of the machine will be raised. In addition, the direction of grinding cylinders 3 will be reversed by reversing their motors and carrier rolls 79 will be reversed due to reversal of tramsission $t$.

In FIG. 13 another embodiment of carrier and satellite roll construction is shown which differs from that shown in FIG. 12 in that this embodiment is manually operated, rather than automatically operated as in the embodiment shown in FIG. 12. The manual embodiment shown in FIG. 13 is mounted on the same structure *a* at each end thereof adjacent each of the carrier rolls 79.

In this embodiment, a rubber covered satellite roll 95 is mounted on a toothed sector 96. The sector 96 is angularly displaceable in an arc about a pivot pin 97 which is mounted to the structure *a*. The toothed sector 96 meshes with a pinion 98 which is coaxially mounted on a gear 99. A worm gear 100 is operated by a handwheel 101 and meshes with gear 99 such that when the handwheel 101 is rotated, gear 100 rotates gear 99 and its pinion 98 to drive the toothed sector 96 about its pivot pin 97 and, thereby, move the satellite roll 95 upward or downward relative to carrier roll 79 as previously described with respect to FIG. 12.

It should be understood that the embodiments of the present invention which have been described are merely illustrative of some of the applications of the principles of the invention. Numerous modifications may be made by those skilled in the art without departing from the true spirit and scope of the invention.

I claim:

1. Apparatus for continuously conditioning fabric including means for moving the fabric through the apparatus with substantially negligible longitudinal tension, said means comprising rotating roll means at opposite ends of said apparatus, and means for varying the frictional contact between said roll means and the fabric so that such contact is greater at one end of the apparatus than at the other depending upon the direction of travel of the fabric through the apparatus, guide means for guiding said moving fabric through the apparatus, at least one fabric abrasion cylinder positioned transversely to the direction of movement of the fabric through the apparatus, drive means for rotating said cylinder about an axis transverse to the direction of movement of the fabric, and oscillating means for oscillating said cylinder in a direction transverse to the direction of movement of the fabric, said oscillating means oscillating said cylinder in response to the rotation thereof.

2. The apparatus of claim 1 wherein said drive means comprise an axle upon which said abrasion cylinder rotates, first toothed means on an end of said axle, second toothed means mechanically connected to said first toothed means and mounted for rotation about an axis, rigid arm means pivotally mounted at one end to a stationary element and pivotally mounted at its other end to said second toothed means at a location eccentric to said axis of rotation of said second toothed means, whereby said axle drives said toothed means to cause said toothed means, said axle and said abrasion cylinder to oscillate transverse to the direction of movement of said fabric.

3. The apparatus of claim 2 wherein said first toothed means comprise an endless thread on the end of said axle and said second toothed means comprise a gear continuously intermeshing with said endless thread.

4. The apparatus of claim 3, wherein said guide means comprise a guide roller, arm means pivotally mounted to said apparatus at one end adjacent the guide roller, said abrasion cylinder being mounted on the other end of said arm means, said arm means including drive means for pivoting said arm means about said one end for adjusting the elevation of said abrasion cylinder relative to said guide roller and said fabric, supply and take-up roller means at each end of the apparatus, each said supply and take-up roller means being mounted upon an axle for rotation, plate means mounted on one end of each said axle, drive means for driving said plate means, at least one engaging means also mounted on each said axle for rotation therewith and being movable axially on said axle, control means for selectively engaging and disengaging said plate drive means and said engaging means, said engaging means comprising a friction surface engageable with said plate means, and said control means including fluid valve means for regulating the pressure on said friction surface to control the speed of said roller means, said control means including means for reversing the direction of the fabric through the apparatus.

5. The apparatus of claim 4 including means for regulating the speed and direction of rotation of said abrasion cylinder relative to the speed and direction of travel of the fabric through the apparatus.

6. The apparatus of claim 4 wherein said means for varying the frictional contact comprises satellite roll means movable relative to at least one of said rotating roll means.

7. The apparatus of claim 1 including means for adjusting the elevation of said abrasion cylinder relative to said guide means and said fabric.

8. The apparatus of claim 7 wherein said guide means comprise a plurality of guide rollers spaced in the direction of travel of the fabric, and said abrasion cylinder is adjustable in elevation between at least a pair of said guide rollers.

9. The apparatus of claim 1, wherein said guide means comprise a plurality of guide rollers spaced in the direction of travel of the fabric, arm means pivotally mounted to said apparatus at one end adjacent the guide rollers, said abrasion cylinder being mounted on the other end of said arm means, said arm means including drive means for pivoting said arm means about said one end for adjusting the elevation of said abrasion cylinder relative to said guide rollers and said fabric.

10. The apparatus of claim 9 wherein said arm drive means comprises a toothed sector engaging said arm means and control means for driving said sector.

11. The apparatus of claim 1 including aspirating means for removing debris from said fabric during abrasion.

12. The apparatus of claim 1 including supply and take up roller means at each end of the apparatus, each said supply and take up roller means being mounted upon an axle for rotation, plate means mounted on one end of each said axle, drive means for driving said plate means, at least one engaging means also mounted on each said axle for rotation therewith and being movable axially on said axle, and control means for selectively engaging and disengaging said plate drive means and said engaging means.

13. The apparatus of claim 12 wherein said means for varying the frictional contact comprises satellite roll means movable relative at least one of said rotating roll means.

14. The apparatus of claim 12 wherein each said engaging means comprises a friction surface engageable with said plate means, and said control means includes fluid valve means for regulating the pressure on said friction surface to control the speed of the corresponding means.

15. The apparatus of claim 12 wherein said control means includes means for reversing the direction of the fabric through the apparatus.

16. The apparatus of claim 1 including means for regulating the speed and direction of rotation of said abrasion cylinder relative to the speed and direction of travel of the fabric through the apparatus.

17. The apparatus of claim 1 wherein said oscillating means is driven by said rotating abrasion cylinder.

18. The apparatus of claim 1 wherein said means for varying the frictional contact comprises satellite roll means movable relative to at least one of said rotating roll means.

19. Apparatus for continuously conditioning fabric including means for moving the fabric through the apparatus, said means comprising rotating roll means at opposite ends of said apparatus, means for varying the frictional contact between said roll means and the fabric so that such contact is greater at one end of the apparatus than at the other depending upon the direction of travel of the fabric through the apparatus, guide means for guiding said moving fabric through the apparatus, at least one fabric abrasion cylinder positioned transversely to the direction of movement of the fabric through the apparatus, drive means for rotating said cylinder about an axis transverse to the direction of movement of the fabric, and oscillating means for oscillating said cylinder in a direction transverse to the direction of movement of the fabric, said oscillating means oscillating said cylinder in response to the rotation thereof.

20. The apparatus of claim 19 wherein said means for varying the frictional contact comprises satellite roll means movable relative to at least one of said rotating roll means.

* * * * *